US011571885B2

(12) United States Patent
Kobayashi et al.

(10) Patent No.: US 11,571,885 B2
(45) Date of Patent: Feb. 7, 2023

(54) METHOD FOR MANUFACTURING PRINTING APPARATUS, AND PRINTING APPARATUS

(71) Applicant: SEIKO EPSON CORPORATION, Tokyo (JP)

(72) Inventors: Saori Kobayashi, Nagano (JP); So Yokota, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 274 days.

(21) Appl. No.: 17/107,987

(22) Filed: Dec. 1, 2020

(65) Prior Publication Data

US 2021/0162736 A1 Jun. 3, 2021

(30) Foreign Application Priority Data

Dec. 3, 2019 (JP) ..... JP2019-218555

(51) Int. Cl.
*B41J 2/045* (2006.01)
*B41J 2/21* (2006.01)
*B41J 25/00* (2006.01)

(52) U.S. Cl.
CPC ..... *B41J 2/04505* (2013.01); *B41J 2/04508* (2013.01); *B41J 2/2135* (2013.01); *B41J 25/001* (2013.01); *B41J 2203/01* (2020.08)

(58) Field of Classification Search
None
See application file for complete search history.

(56) References Cited

U.S. PATENT DOCUMENTS 7,773,774 B2 8/2010 Rasmussen et al.
9,501,842 B2 * 11/2016 Totsuka ..... H04N 1/6027
2011/0242174 A1 * 10/2011 Kakutani ..... H04N 1/405 347/15
2018/0086049 A1 * 3/2018 Ueshima ..... B41J 2/2139

FOREIGN PATENT DOCUMENTS

JP 2006-014332 A 1/2006

* cited by examiner

*Primary Examiner* — Kristal Feggins
(74) *Attorney, Agent, or Firm* — Global IP Counselors, LLP

(57) ABSTRACT

A printing apparatus configured to perform printing while varying an amount of adjustment of a target of adjustment, executing: printing a first adjustment pattern on a printing medium; reading the printed first adjustment pattern to acquire a first adjustment amount; printing a part of a second adjustment pattern on the printing medium, the printed part of the second adjustment pattern corresponding to only a part of the amount of adjustment according to the first adjustment pattern; reading the printed part of the second adjustment pattern to acquire a second adjustment amount; setting a first parameter that is a result of adjusting the target of adjustment by using the first adjustment amount; and setting a second parameter that is a result of adjusting the target of adjustment by using the second adjustment amount.

5 Claims, 8 Drawing Sheets

METHOD FOR MANUFACTURING PRINTING APPARATUS, AND PRINTING APPARATUS

The present application is based on, and claims priority from JP Application Serial Number 2019-218555, filed Dec. 3, 2019, the disclosure of which is hereby incorporated by reference herein in its entirety.

BACKGROUND

1. Technical Field

Embodiments of the present disclosure relate to a method for manufacturing a printing apparatus, and a printing apparatus.

2. Related Art

A printing apparatus capable of improving the quality of an image by adjusting a variable adjustment amount is known in the art. For example, a technique of generating a test pattern is disclosed in JP-A-2006-014332.

To obtain an ideal adjustment result in a printing apparatus, in general, an adjustment pattern is printed with different values of the amount of adjustment, and an ideal adjustment result is determined based on the adjustment pattern. However, if the adjustment pattern is printed while varying the amount of adjustment within the maximum variable range of the amount of adjustment in order to determine an ideal adjustment result, the amount of printing the adjustment pattern will be inevitably large.

SUMMARY

An advantage of some aspects of the present disclosure is to provide a technique for efficiently printing an adjustment pattern in order to obtain an ideal adjustment result. This makes it possible to make an ideal adjustment with a smaller amount of printing than in the art, thereby making it possible to manufacture a printing apparatus adjusted ideally.

Provided by one aspect of the present disclosure is a method for manufacturing a printing apparatus configured to perform printing while varying an amount of adjustment of a target of adjustment, comprising: printing a first adjustment pattern on a printing medium; reading the printed first adjustment pattern to acquire a first adjustment amount; printing a part of a second adjustment pattern on the printing medium, the printed part of the second adjustment pattern corresponding to only a part of the amount of adjustment according to the first adjustment pattern; reading the printed part of the second adjustment pattern to acquire a second adjustment amount; setting a first parameter that is a result of adjusting the target of adjustment by using the first adjustment amount; and setting a second parameter that is a result of adjusting the target of adjustment by using the second adjustment amount.

If the first adjustment pattern is printed while varying the amount of adjustment, the printing will be performed with differences in print quality, differing from amount to amount of adjustment. Therefore, it is possible to determine the first adjustment amount that is suitable based on the print quality of the first adjustment pattern. Once the first adjustment amount that is suitable has been determined, it is possible to estimate the amount of adjustment with which the quality of printing will be good and the amount of adjustment with which the quality of printing will not be good in the second adjustment pattern that is to be printed on the premise that an adjustment based on the first adjustment amount has been done. Therefore, by excluding the amount of adjustment with which the quality of printing will not be good and by printing a part of a second adjustment pattern corresponding to only a part of the amount of adjustment, it is possible to make the amount of printing the second adjustment pattern smaller, as compared with a case where printing is performed while adjusting the amount of adjustment for the entirety of the second adjustment pattern. Therefore, it is possible to perform adjustment pattern printing efficiently. The printed adjustment pattern may be read by a sensor to acquire the amount of adjustment. The printed adjustment pattern may be read by a human who makes an input via a keyboard, thereby acquiring the amount of adjustment.

In setting the first parameter, the first parameter may be stored in a first area of a nonvolatile memory, and, in setting the second parameter, the second parameter may be stored in a second area different from the first area of the nonvolatile memory. This configuration enables the printing apparatus to operate according to different parameters set using the amount of adjustment determined based on different adjustment patterns.

The first parameter may be a parameter that is used when printing with first print quality is performed and is not used when printing with second print quality is performed, and the second parameter may be a parameter that is used when printing with the second print quality is performed and is not used when printing with the first print quality is performed. This configuration makes it possible to provide a printing apparatus that performs printing with parameters for predetermined levels of print quality.

A range of the part of the amount of adjustment according to the first adjustment pattern may be relatively narrow when a minimum value of misalignment occurring in the first adjustment pattern is relatively small, as compared with when the minimum value is relatively large. This configuration makes it possible to vary the amount of printing the second adjustment pattern depending on the amount of adjustment acquired using the first adjustment pattern.

The following configuration may be adopted: A printing apparatus configured to perform printing while varying an amount of adjustment of a target of adjustment, executing: printing a first adjustment pattern on a printing medium; reading the printed first adjustment pattern to acquire a first adjustment amount; printing a part of a second adjustment pattern on the printing medium, the printed part of the second adjustment pattern corresponding to only a part of the amount of adjustment according to the first adjustment pattern; reading the printed part of the second adjustment pattern to acquire a second adjustment amount; setting a first parameter that is a result of adjusting the target of adjustment by using the first adjustment amount; setting a second parameter that is a result of adjusting the target of adjustment by using the second adjustment amount; and performing printing using the set parameters. That is, a printing apparatus capable of printing an adjustment pattern efficiently may be provided.

DESCRIPTION OF EXEMPLARY EMBODIMENTS

Exemplary embodiments of the present disclosure will now be explained in the following order.

(1) First embodiment
(2) Printing an adjustment pattern
(3) Adjustment processing
(4) Other embodiments

(1) First Embodiment

Figure 1:
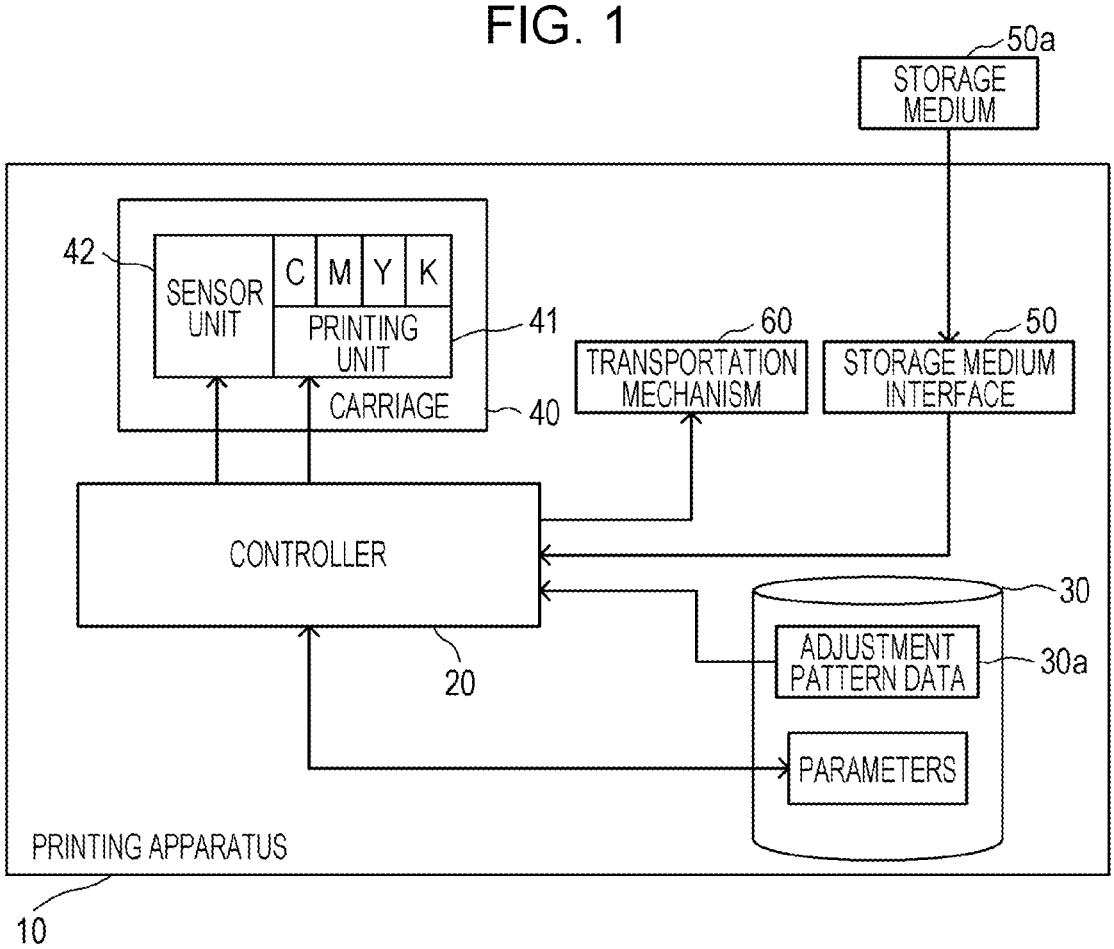
FIG. 1 is a block diagram of a printing apparatus according to an exemplary embodiment of the present disclosure.

FIG. 1 is a block diagram that illustrates the configuration of a printing apparatus 10 according to an exemplary embodiment of the present disclosure. The printing apparatus 10 includes a controller 20 and a nonvolatile memory 30. The controller 20 includes a RAM, and a processor such as a CPU. A print control program and an adjustment program, which are stored in the nonvolatile memory 30, are able to be run on the controller 20. Any storage medium can be used as the nonvolatile memory 30 as long as the stored content is retained even after the printing apparatus 10 is powered off. Therefore, a storage medium of other kind, instead of the memory, may be used. The processor may be an ASIC.

When the print control program is run, the controller 20 is able to control a printing unit 41 and a transportation mechanism 60, etc. to print an image on a printing medium. The adjustment program is a program for adjusting variable factors in the printing apparatus 10 in order to prevent a decrease in print quality due to an error occurring in the printing apparatus 10. When the adjustment program is run, the controller 20 is able to control the printing unit 41 and the transportation mechanism 60, etc. to print an adjustment pattern on a printing medium. The controller 20 is able to control a sensor unit 42 and the transportation mechanism 60, etc. to read the printing medium.

The printing apparatus 10 according to the present embodiment is an ink-jet printer. The printing apparatus 10 includes a carriage 40, a storage medium interface 50, and the transportation mechanism 60. A portable storage medium 50*a* can be attached to the storage medium interface 50. The controller 20 is able to acquire various kinds of data including image data from the attached storage medium 50*a*. Needless to mention, the source from which the image data, etc. is acquired is not limited to the portable storage medium 50*a*. The image data, etc. may be acquired from a computer connected via wired or wireless communication, etc. Various kinds of configuration can be adopted.

The transportation mechanism 60 is a device that transports a printing medium in a predetermined direction. The controller 20 is able to control the transportation mechanism 60 to transport a printing medium in a predetermined procedure. The printing unit 41 and the sensor unit 42 are mounted on the carriage 40. The controller 20 is able to cause the carriage 40 to reciprocate in a predetermined direction. In the printing apparatus 10, the carriage 40 is designed to move in the predetermined direction while being kept at a predetermined distance from a platen.

The printing unit 41 includes a print head and ink tanks. The print head ejects ink of four types of color, which are CMYK (C: cyan, M: magenta, Y: yellow, K: black). The ink tanks are attached to the print head and contain the ink of CMYK respectively. Needless to mention, these ink colors, and the number of the colors, are nothing more than an example. Ink of other types of color and other number of colors may be used instead. The print head has a plurality of ejection nozzles arranged in a direction orthogonal to the direction of movement of the carriage 40. The controller 20 is able to control the amount of ink ejected from each ejection nozzle, the timing of ejection, etc.

Therefore, it is possible to print an image on a printing medium by ejecting ink of the colors from the ejection nozzles in the process of moving the carriage 40 in the predetermined direction. It is possible to print an image at a targeted position in a printable area on a printing medium by repeating the transportation of the printing medium by the transportation mechanism 60, the movement of the carriage 40, and the ejection of ink from the print head. In the present embodiment, the direction in which a printing medium is transported is referred to as sub-scan direction, and the direction in which the carriage 40 moves is referred to as main-scan direction.

The sensor unit 42 has a function of reading a printing medium on the platen. In the present embodiment, on the carriage 40, the sensor unit 42 is provided next to the print head of the printing unit 41 in the main-scan direction. Therefore, the controller 20 is able to move the sensor unit 42 in the main-scan direction by moving the carriage 40. In the present embodiment, because of the movement of the sensor unit 42, the entirety of the printable area on the printing medium in the main-scan direction can be captured within the field of vision. Accordingly, the printed image can be read no matter where in the main-scan direction it is printed.

(2) Printing an Adjustment Pattern

In the present embodiment, the result of reading by the sensor unit 42 can be used for keeping or enhancing print quality. The printing apparatus 10 according to the present embodiment will be able to perform printing with predetermined expected quality if components such as the carriage 40 and the transportation mechanism 60, etc. have sizes as designed, are assembled as designed, and operate as designed. However, a decrease in print quality could happen due to a possible error in at least a part of these factors. By making adjustments for various kinds of target of adjustment corresponding to the error factors, the printing apparatus 10 according to the present embodiment is able to be brought into a finished-product state, in which it is possible to perform printing with predetermined expected quality, from an unfinished state, in which the quality of printing is low due to the error.

Specifically, for example, in the printing apparatus 10, the carriage 40 is designed to move in the main-scan direction while keeping a distance between the carriage 40 and a printing medium (i.e., platen gap) at a predetermined value. However, the actual platen gap could be different from the predetermined value, for example, due to a possible deviation in position and/or shape of the platen from the design or due to a possible deviation in position and/or moving direction of the carriage 40 from the design.

Figure 2:
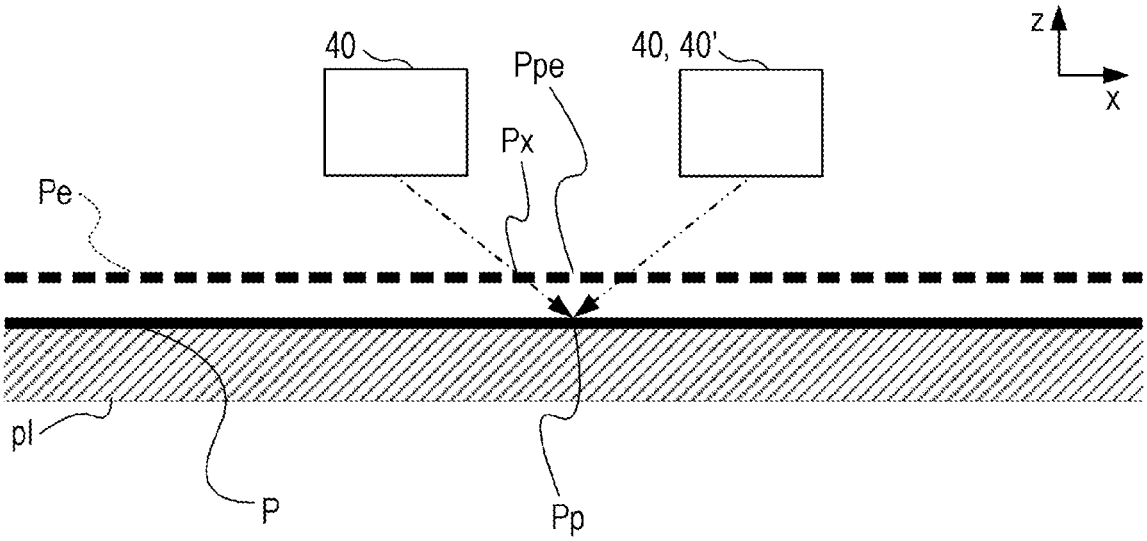
FIG. 2 is a diagram for explaining misalignment in print position of ink ejected from a carriage.

FIG. 2 is a schematic view of a structure in the neighborhood of the carriage 40 and a platen p1. In FIG. 2, x denotes the main-scan direction, and z denotes the direction perpendicular to the print surface. Therefore, the sub-scan direction is the figure's depth direction perpendicular to the x direction and the z direction. In the present embodiment, the sub-scan direction is referred to also as y direction. In FIG. 2, the platen p1 is shown by hatching, and the thick solid straight line represents a printing medium P on the platen p1.

In FIG. 2, a print mode in which the carriage 40 reciprocates in the main-scan direction is supposed. That is, the carriage 40 is able to eject ink while moving in the x direction and is further able to eject ink while moving in the direction that is the opposite of the x direction. In FIG. 2, the dot-and-dash line indicates the trajectory of an ejected ink droplet traveling in air from the carriage 40 moving in the x direction toward a print position pp, and the double-dotted dashed line indicates the trajectory of an ejected ink droplet traveling in air from the carriage 40 moving in the direction that is the opposite of the x direction toward the print position pp.

Each of the traveling trajectory indicated by the dot-and-dash line and the traveling trajectory indicated by the double-dotted dashed line is an example of a case where the platen gap and the moving speed in the printing apparatus 10 are as designed and thus where printing is performed with predetermined expected quality with the recording of the ink at the print position pp. If they are as designed, the ink droplet ejected toward the print position pp lands at the print position pp regardless of whether the carriage 40 moves in the x direction or in the direction that is the opposite of the x direction. However, if any component of the printing apparatus 10 contains an error with a deviation from the design, an error could occur in the position where the ink is recorded.

In FIG. 2, the thick broken line schematically represents a printing medium Pe when there is an error in the platen gap. When there is an error in the platen gap, if ink is ejected as designed as indicated by the dot-and-dash line and the double-dotted dashed line, the ink will not be recorded at a designed print position Ppe. Therefore, in the present embodiment, an adjustment is made while taking, as the target of adjustment, at least one of variable factors in the printing apparatus 10, thereby bringing print quality into predetermined expected quality or equivalent to predetermined expected quality. For example, in the example illustrated in FIG. 2, misalignment in print position due to deviation from the design of the platen gap will be eliminated if ink is ejected from the carriage 40 (40') moving in the direction that is the opposite of the x direction so that the ink will be recorded at a print position Px.

The target of adjustment in the present embodiment is a factor that could change the result of printing by selecting the amount of adjustment. Examples of such factors are: the timing of ejecting ink, the speed of moving the print head, the amount of ink ejected, the waveform and magnitude of a voltage for ejecting ink, the amount of feeding a sheet. In the present embodiment, one of these factors is taken as the target of adjustment, and an ideal adjustment amount is determined by printing an adjustment pattern that is constituted of a plurality of patterns whose amount of adjustment of the target of adjustment is varied. In the following description, when it is intended to distinguish a part of an adjustment pattern from a whole of the adjustment pattern, each individual part printed with the same amount of adjustment in patterned arrangement is simply referred to as "pattern", and the entire series of patterned arrangement formed by the plurality of patterns is referred to as "adjustment pattern".

Figure 3:
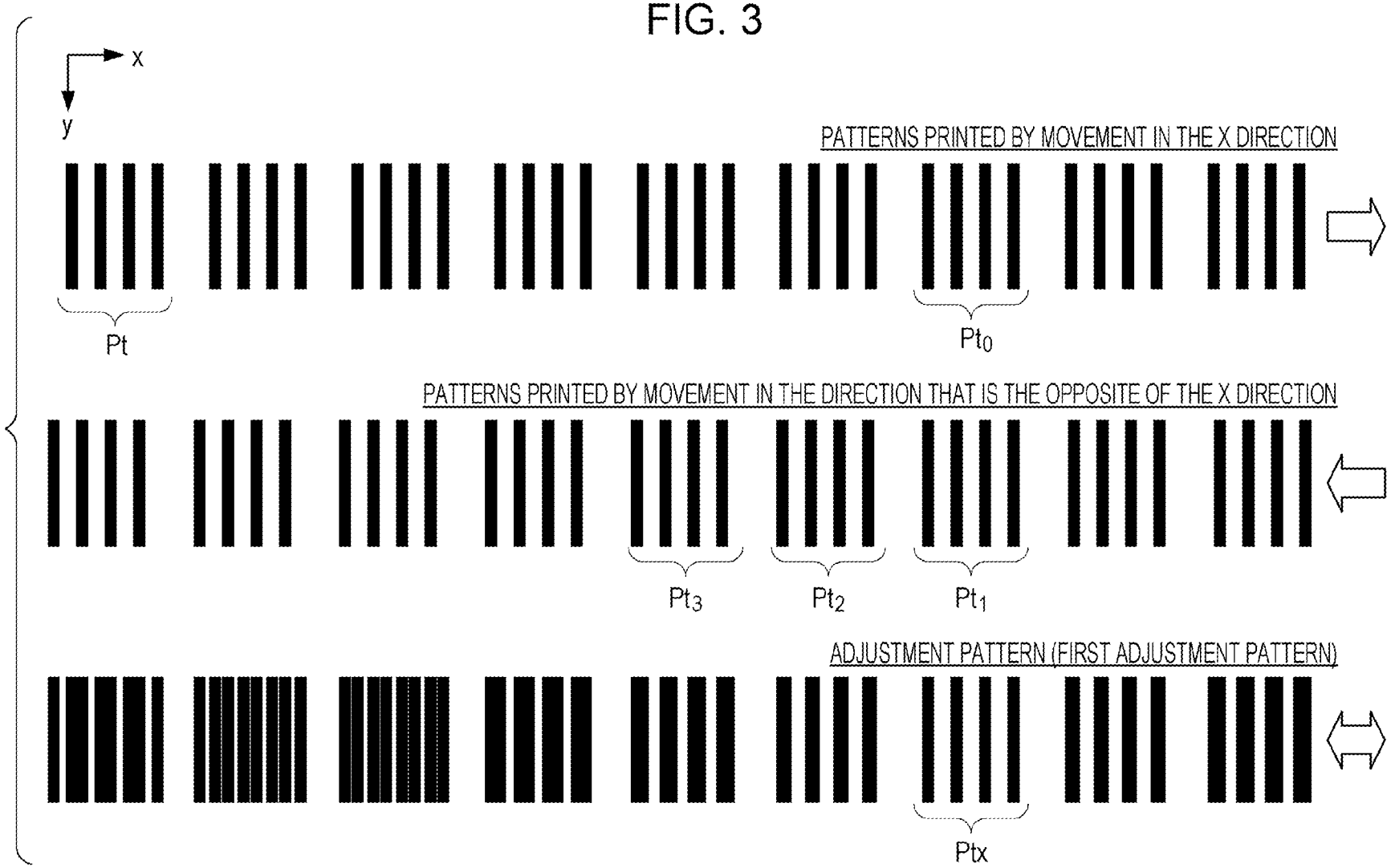
FIG. 3 is a diagram for explaining a first adjustment pattern.

The adjustment pattern according to the present embodiment includes bars printed while keeping the amount of adjustment fixed and bars printed while varying the amount of adjustment, and is configured such that an ideal adjustment amount can be determined by examining the degree of overlapping of the former with the latter. The shape of the pattern is not limited to this example. It suffices to design the pattern suitably for the target of adjustment. FIG. 3 is a diagram for explaining an adjustment pattern. The adjustment pattern illustrated in FIG. 3 is printed for the purpose of eliminating an error in print position when the carriage 40 is moved in the x direction and in the direction that is the opposite of the x direction.

Specifically, the adjustment pattern illustrated in FIG. 3 is used for clearly visualizing the misalignment in print position arising between the directions that are the opposite of each other when the carriage 40 reciprocates. The adjustment pattern illustrated in FIG. 3 is printed by reciprocation of the carriage 40. In FIG. 3, an example of the adjustment pattern printed is shown at the bottom row. In FIG. 3, among the patterns that constitute the adjustment pattern, patterns that are printed when the carriage 40 moves in the x direction are shown at the top row, and patterns that are printed when the carriage 40 moves in the direction that is the opposite of the x direction are shown at the middle row.

In the adjustment pattern illustrated in FIG. 3, each one pattern (for example, a pattern Pt in the top row in FIG. 3) is formed by arranging a plurality of line segments at predetermined intervals in the main-scan direction, wherein each of the plurality of line segments extends in the sub-scan direction (y direction). In the example illustrated in FIG. 3, nine patterns explained here are printed next to one another in a row. The color of the bars constituting each pattern is not specifically limited. In FIG. 3, it is supposed that each CMYK ink is used for printing one bar. In this example, the amount of adjustment when the carriage 40 moves in the x direction is not varied from a predetermined adjustment amount. Therefore, as shown at the top row in FIG. 3, a bar-to-bar pitch in each pattern Pt is constant, and a pattern-to-pattern pitch between two adjacent patterns Pt is also constant.

In the adjustment pattern illustrated in FIG. 3, each one pattern printed when the carriage 40 moves in the direction that is the opposite of the x direction is also formed by arranging a plurality of line segments at predetermined intervals in the main-scan direction, wherein each of the plurality of line segments extends in the sub-scan direction (y direction). Nine patterns explained here are arranged in the main-scan direction. The amount of adjustment for these opposite-direction patterns is made different from the predetermined adjustment amount, varying from one to another of the nine patterns, such that the change in the amount of adjustment increases from one end to the other end in the main-scan direction.

For example, in the example shown at the middle row in FIG. 3, the timing of ejecting ink is different from one to another of patterns $Pt_1$, $Pt_2$, and $Pt_3$. Specifically, the timing of ejecting ink for the pattern $Pt_1$ is relatively delayed in comparison with the timing of ejecting ink for the pattern $Pt_2$, and the timing of ejecting ink for the pattern $Pt_2$ is relatively delayed in comparison with the timing of ejecting ink for the pattern $Pt_3$. As explained above, in the adjustment pattern according to the present embodiment, the timing of ejecting ink, as the amount of adjustment, varies gradually in accordance with the order of arrangement of the individual patterns.

The adjustment pattern illustrated at the bottom row in FIG. 3 is obtained by overlapping the patterns printed when the carriage 40 moves in the x direction with the patterns printed when the carriage 40 moves in the direction that is the opposite of the x direction. As illustrated in FIG. 3, a bar will be thin if ink ejected during movement in the x direction and ink ejected during movement in the direction that is the opposite of the x direction match. A bar will be thick if the two do not match due to misalignment.

For example, in the example illustrated in FIG. 3, a comparison of the patterns printed when the carriage 40 moves in the x direction with the patterns printed when the carriage 40 moves in the direction that is the opposite of the x direction reveals that the misalignment is the minimum between a pattern $Pt_0$ in the former and a pattern $Pt_1$ in the latter. Therefore, in the adjustment pattern illustrated at the bottom row in FIG. 3, the lightness of a pattern Ptx is highest. Therefore, in the pattern example illustrated in FIG. 3, the timing of ejecting ink for the pattern Ptx, which has the highest lightness among the individual patterns, can be said to be most ideal.

The amount of adjustment is varied at a change pitch determined in advance within a range determined in advance when the carriage 40 moves in the direction that is the opposite of the x direction. Each of the nine patterns printed by moving the carriage 40 in the direction that is the opposite of the x direction is associated with the amount of adjustment applied when the pattern is printed. By finding the pattern that has the highest lightness among those in the adjustment pattern, therefore, it is possible to determine the amount of adjustment corresponding to the found pattern as an ideal adjustment amount.

The adjustment pattern explained above is used for making an adjustment for the mismatch in the timing of ejecting ink when the carriage 40 reciprocates. Needless to mention, however, various kinds of other adjustment pattern may be used. Anyway, in the present embodiment, it is possible to determine an ideal adjustment amount by utilizing the overlapping of patterns printed with the amount of adjustment that is not different from setting and patterns printed while making the amount of adjustment different from the setting.

Figure 4:
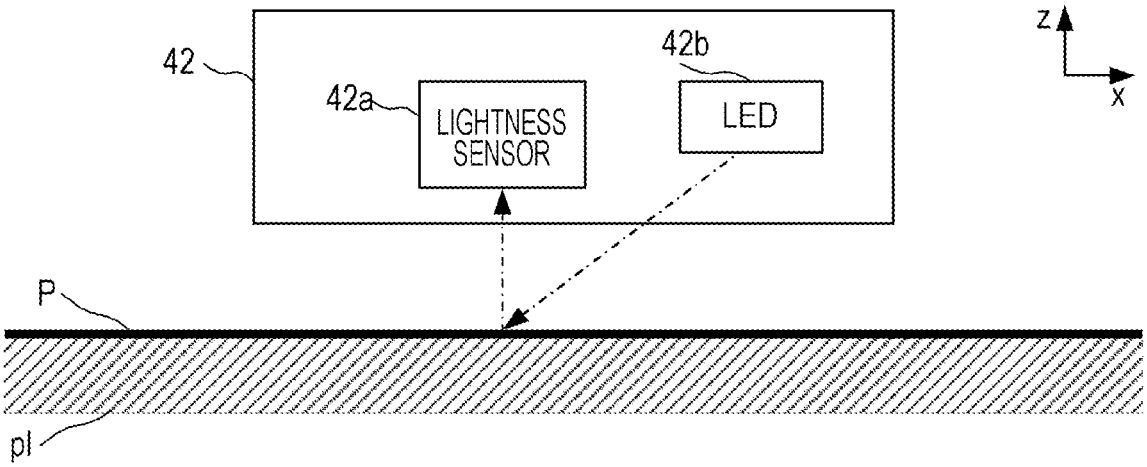
FIG. 4 is a diagram for explaining a sensor unit.

For the purpose of determining the above-described adjustment amount and making settings automatically, the printing apparatus 10 according to the present embodiment is equipped with the sensor unit 42. FIG. 4 schematically illustrates the configuration of the sensor unit 42. In FIG. 4, the sensor unit 42, the printing medium P, and the platen p1 are schematically illustrated. In FIG. 4, x denotes the main-scan direction, and z denotes the direction perpendicular to the print surface.

As illustrated in FIG. 4, the sensor unit 42 according to the present embodiment includes a lightness sensor 42*a* and an LED 42*b*. In the present embodiment, the lightness sensor 42*a* needs only to be able to detect the lightness (density) of each of patterns that constitute an adjustment pattern. For example, the lightness sensor 42*a* is a photodiode. In the present embodiment, since the misalignment becomes clear based on the lightness of the adjustment pattern, the lightness is detected by the lightness sensor 42*a*. Needless to mention, however, any other kind of sensor may be used if any other feature in the adjustment pattern should be detected. For example, an area sensor such as a CMOS or a CCD may be used.

The LED 42*b* is a light source for lighting the area of detection by the lightness sensor 42*a*. In FIG. 4, light emitted from the LED 42*b* and reaching the lightness sensor 42*a* is schematically indicated by dot-and-dash line arrows. When the printing medium P with the adjustment pattern printed thereon is lit by the LED 42*b*, light corresponding to the lit adjustment pattern reaches the lightness sensor 42*a*. Based on an output signal from the lightness sensor 42*a*, the controller 20 detects the lightness of the adjustment pattern.

The controller 20 detects the lightness of each of the patterns that constitute the adjustment pattern (in the example illustrated in FIG. 3, the nine patterns in the bottom row), and determines the pattern that has the highest lightness. Then, the controller 20 acquires the amount of adjustment associated with the pattern that has the highest lightness, thereby determining a parameter (value indicating the amount of adjustment) that should be set when printing is performed. The light source is not limited to an LED. Any other type of a light source may be used. The color is not specifically limited as long as necessary information is readable. The sensor unit 42 may include other component, for example, an optical component such as a lens.

The above-described adjustment using the adjustment pattern is made for a plurality of factors. That is, in the printing apparatus 10, a parameter indicating the amount of adjustment for each of a plurality of targets of adjustment is determined and set based on the adjustment pattern. Moreover, even when the target of adjustment is the same, printing could be performed using a different amount of adjustment for a different level of print quality. For example, mode selection is available also in a scheme of performing printing while reciprocating the carriage 40, such as selecting one of a mode for performing printing with first print quality that is relatively high ("quality-first mode") and a mode for performing printing with second print quality that is relatively low but faster in print speed ("speed-first mode"). In the printing apparatus 10, for each of these modes, a parameter indicating the amount of adjustment for each of a plurality of targets of adjustment is determined and set based on the adjustment pattern.

As explained above, in the present embodiment, based on adjustment patterns for modes corresponding to different levels of print quality, adjustments for these levels of print quality are made. In such adjustments, a later adjustment pattern is printed in a state in which the amount of adjustment for an earlier adjustment has already been determined by using an earlier adjustment pattern. On the premise that the adjustment procedure using the earlier adjustment pattern has already been done, it is possible to narrow down the range of printing (the number of patterns to be printed) of the later adjustment pattern.

For example, suppose that the amount of adjustment for the first print quality and the amount of adjustment for the second print quality are acquired using adjustment patterns that are similar to the adjustment pattern illustrated at the bottom row in FIG. 3. In the following description, an adjustment pattern for printing with the first print quality is referred to as first adjustment pattern, and an adjustment pattern for printing with the second print quality is referred to as second adjustment pattern.

In addition, in this example, as shown at the bottom row in FIG. 3, suppose that the first adjustment pattern constituted of nine patterns has been printed while varying the amount of adjustment for the first print quality, and an ideal adjustment amount has been determined based on the pattern Ptx.

In this instance, next, the amount of adjustment for the second print quality is determined using the second adjustment pattern. The amount of adjustment for the second print quality has the same tendency as that of the amount of adjustment for the first print quality. That is, since the carriage 40 reciprocates both when printing with the first print quality is performed and when printing with the second print quality is performed, the cause of an error is common to these two. For example, if there is an error of a decreasing platen gap as shown in FIG. 2, it is possible to eliminate the misalignment in print position by making the timing of ejecting ink when the carriage 40 moves in the direction that is the opposite of the x direction later than the initial designed timing. This tendency is common to the first print quality and the second print quality.

Since the amount of adjustment for the first print quality has already been determined using the first adjustment pattern, therefore, it suffices to perform pattern printing with the amount of adjustment having the same tendency for the second print quality. It is unnecessary to perform pattern printing with the amount of adjustment having a different tendency. For example, in the example illustrated in FIG. 2, it is possible to omit patterns that are to be printed while making the timing of ejecting ink when the carriage 40 moves in the direction that is the opposite of the x direction earlier than the initial designed timing.

Considering that the amount of adjustment for the first print quality has already been determined in the example illustrated in FIG. 3, it suffices to print the second adjustment pattern such that the second adjustment pattern is constituted of only patterns printed with the amount of adjustment having the same tendency as that of the amount of adjustment for the first print quality. When it is possible to print an adjustment pattern constituted of nine patterns as illustrated in FIG. 3 for each of the first print quality and the second print quality, a reference to the amount of adjustment determined using the first adjustment pattern makes it possible to make the number of patterns printed with the second print quality smaller than nine.

Figure 5:
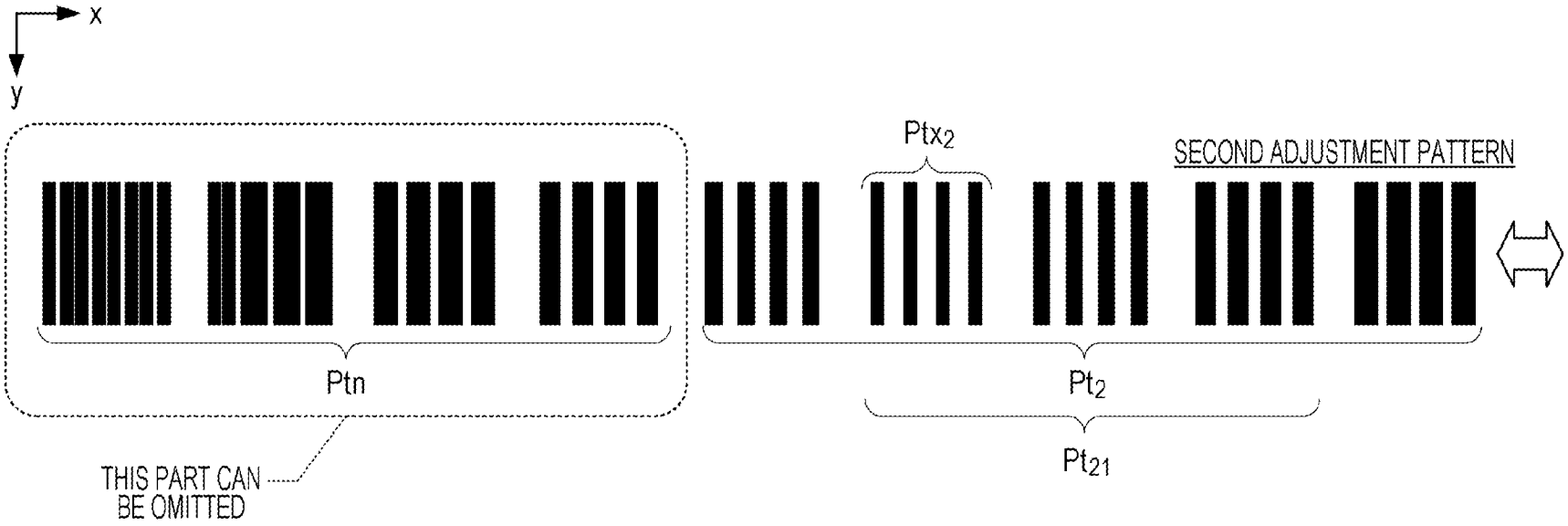
FIG. 5 is a diagram for explaining a second adjustment pattern.

Specifically, suppose that the first adjustment pattern illustrated in FIG. 3 has been printed with the first print quality, and the pattern Ptx illustrated in FIG. 3 has the highest lightness. In this instance, it is possible to reduce the number of patterns to be printed, by limiting the range to the amount of adjustment of a similar tendency. FIG. 5 schematically illustrates the second adjustment pattern for a case where the amount of adjustment is varied throughout the entire range. In this example, patterns Ptn, the amount of adjustment of which is of a different tendency, can be omitted when the pattern that has the highest lightness in the first adjustment pattern illustrated in FIG. 3 is the pattern Ptx. Therefore, it suffices to print the rest of patterns, Pte, as the second adjustment pattern.

The adjustment pattern described above has been determined in advance for each target of adjustment such that the difference in the amount of adjustment will appear as the difference in the result of printing, varying from pattern to pattern. Then, adjustment pattern data 30*a* representing an adjustment pattern for each target of adjustment has been defined in advance and stored in the nonvolatile memory 30. In the adjustment pattern data 30*a*, an amount of adjustment is associated with each of the plurality of patterns Pt constituting the adjustment pattern. For example, in the example illustrated in FIG. 3, an amount of adjustment 0 (default value) is associated with the nine patterns printed by movement in the x direction. Different values of the amount of adjustment, varying from pattern to pattern, are associated respectively with the nine patterns printed by movement in the direction that is the opposite of the x direction.

In the present embodiment, based on the amount of adjustment acquired using the earlier adjustment pattern, the controller 20 determines the amount of printing the later adjustment pattern. Therefore, the controller 20 determines the target of adjustment in an order determined in advance or in an order instructed by the user, and commands that the adjustment pattern corresponding to the determined target of adjustment should be printed. That is, the controller 20 looks up the nonvolatile memory 30 to acquire the adjustment pattern data 30*a* corresponding to the target of adjustment.

When adjustments are made respectively for different levels of print quality of the same kind of target of adjustment, adjustment patterns that are to be used for the adjustments respectively have been determined in advance. When a plurality of adjustment patterns is printed for the same kind of target of adjustment, the adjustment pattern printer earlier is the first adjustment pattern, and the adjustment pattern printer later is the second adjustment pattern. The number of adjustment patterns printed for the same kind of target of adjustment may be three or more. However, the number of adjustment patterns is assumed to be two in this example.

In this example, the controller 20 acquires the adjustment pattern data 30*a* representing the first adjustment pattern. Then, the controller 20 controls the carriage 40 and the transportation mechanism 60 to print the first adjustment pattern based on the acquired data. That is, the controller 20 commands that the first adjustment pattern should be printed by printing the patterns in a state in which different values of the amount of adjustment represented by the adjustment pattern data 30*a* are reflected.

After printing the first adjustment pattern, the controller 20 controls the transportation mechanism 60 to move the printing medium to a position where the sensor unit 42 is able to read the portion at which the first adjustment pattern has been printed. Then, the controller 20 causes the sensor unit 42 to read each of the patterns that constitute the first adjustment pattern while controlling the carriage 40 so as to cause the carriage 40 to move in the main-scan direction.

After reading each of the patterns Pt that constitute the first adjustment pattern, the controller 20 acquires the lightness of each pattern. Then, based on the adjustment pattern data 30*a*, the controller 20 acquires the amount of adjustment associated with the pattern that has the highest lightness. The amount of adjustment acquired based on the first adjustment pattern is referred to as first adjustment amount herein. In the example illustrated in FIG. 3, the amount of adjustment associated with the pattern Ptx among those in the first adjustment pattern at the bottom row is the first adjustment amount.

Next, the controller 20 looks up the nonvolatile memory 30 to acquire the adjustment pattern data 30*a* representing the second adjustment pattern. Then, the controller 20 determines the target of printing, that is, patterns that are to be printed from among those in the adjustment pattern data 30*a*. In this determination, the controller 20 chooses, as the target of printing, patterns that are to be printed with the amount of adjustment having the same tendency as that of the first adjustment amount. For example, the controller 20 chooses, as the target of printing, patterns associated with the amount of adjustment included within a predetermined range the center of which is the same as the first adjustment amount. The controller 20 regards patterns associated with the amount of adjustment outside the predetermined range as those that should be excluded from the target of printing.

Then, the controller 20 controls the carriage 40 and the transportation mechanism 60 to print a part of the second adjustment pattern based on the adjustment pattern data 30*a* specifying the patterns that are to be printed as the target of printing. As a result, for example, as illustrated in FIG. 5, a part (i.e., the patterns Ptn) of the second adjustment pattern represented by the adjustment pattern data 30*a* is omitted, and patterns that are not omitted (i.e., the patterns Ptz) are printed. After printing the second adjustment pattern, the controller 20 controls the transportation mechanism 60 to move the printing medium to a position where the sensor unit 42 is able to read the portion at which the second adjustment pattern has been printed. Then, the controller 20 causes the sensor unit 42 to read each of the patterns that constitute (the printed part of) the second adjustment pattern while controlling the carriage 40 so as to cause the carriage 40 to move in the main-scan direction.

After reading each of the patterns Pt ($Pt_2$) that constitute (the printed part of) the second adjustment pattern, the controller 20 acquires the lightness of each pattern Pt ($Pt_2$) Then, based on the adjustment pattern data 30*a*, the controller 20 acquires the amount of adjustment associated with the pattern that has the highest lightness. The amount of adjustment acquired based on the second adjustment pattern is referred to as second adjustment amount herein. In the example illustrated in FIG. 5, the amount of adjustment associated with a pattern $Ptx_2$ among those in the second adjustment pattern at the bottom row is the second adjustment amount.

After acquiring the first adjustment amount and the second adjustment amount, based on each adjustment amount, the controller 20 sets parameters that are to be used for controlling the printing apparatus 10. That is, the controller 20 sets a first parameter that is the result of adjusting the target of adjustment by using the first adjustment amount, and sets a second parameter that is the result of adjusting the target of adjustment by using the second adjustment amount.

The first parameter indicates the amount of adjustment as the result of adjustment determined based on the first adjustment amount. Therefore, the first parameter may be the same as the first adjustment amount or may be an adjustment amount determined from the first adjustment amount. The example in the present embodiment is the former, and the controller 20 makes settings such that the first adjustment amount will be applied when printing with the first print quality is performed. Specifically, the controller 20 causes the nonvolatile memory 30 to store, in a first area, the first parameter for performing printing, with the first adjustment amount applied.

The second parameter indicates the amount of adjustment as the result of adjustment determined based on the second adjustment amount. Therefore, the second parameter may be the same as the second adjustment amount or may be an adjustment amount determined from the second adjustment amount. The example in the present embodiment is the former, and the controller 20 makes settings such that the second adjustment amount will be applied when printing with the second print quality is performed. Specifically, the controller 20 causes the nonvolatile memory 30 to store, in a second area, the second parameter for performing printing, with the second adjustment amount applied. The configuration described above enables the printing apparatus to operate according to different parameters set using the amount of adjustment determined based on different adjustment patterns.

In the present embodiment, the first parameter is a parameter that is used when printing with the first print quality is performed. The first parameter is not used when printing with the second print quality is performed. The second parameter is a parameter that is used when printing with the second print quality is performed. The second parameter is not used when printing with the first print quality is performed. That is, in the present embodiment, regarding each target of adjustment, different adjustment patterns are printed for the purpose of making adjustments for the respective levels of print quality, and parameters suited for the respective levels of print quality are set. Consequently, in the printing apparatus 10 capable of performing printing with different levels of print quality, it is possible to perform printing with the amount of adjustment suited for the respective levels of print quality applied.

In the present embodiment, printing an adjustment pattern, acquiring an adjustment amount, and setting a parameter are performed for each target of adjustment and for each level of print quality. Therefore, it can be said that a printing apparatus that eliminates print misalignment will be manufactured. In the configuration described above, it is possible to limit the target of printing of the second adjustment pattern in accordance with acquiring the first adjustment amount. Therefore, when printing is performed with different levels of print quality for the same target of adjustment, it is possible to make the amount of printing the second adjustment pattern smaller, as compared with a case where printing is performed while adjusting the amount of adjustment for the entirety of the second adjustment pattern. Consequently, it is possible to perform adjustment pattern printing efficiently.

(3) Adjustment Processing

Figure 6:
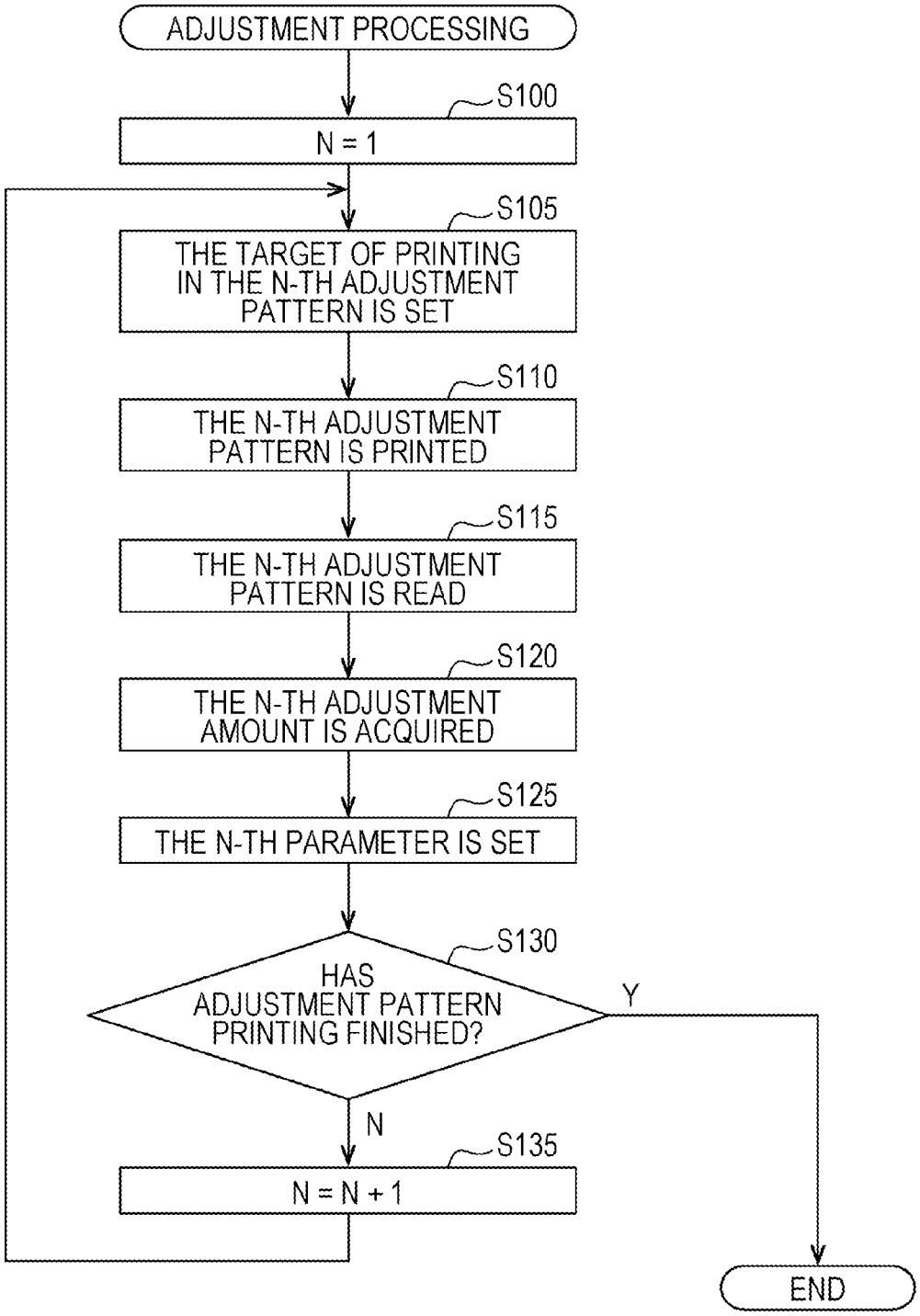
FIG. 6 is a flowchart of adjustment processing.

FIG. 6 is a flowchart of adjustment processing. The adjustment processing illustrated in FIG. 6 is performed for each of a plurality of targets of adjustment. Upon determination of the target of adjustment, the controller 20 initializes a variable N for the determined target of adjustment into 1 (step S100). The variable N indicates the number of adjustment patterns that are to be printed for an identical target of adjustment. In this example, this number corresponds to the number of modes that are executable (the number of modes of different print quality).

Next, the controller 20 sets the target of printing in an N-th adjustment pattern (step S105). The following is a more detailed explanation. The controller 20 limits the range of printing of the next adjustment pattern based on printing the preceding adjustment pattern. Therefore, the controller 20 looks up the nonvolatile memory 30 to acquire the adjustment pattern data 30*a* of the N-th adjustment pattern. In the present embodiment, the order of adjustment patterns that are to be printed for the purpose of setting the amount of adjustment of the target of adjustment (i.e., the order of print quality for which adjustments are made) has been determined in advance. Therefore, the adjustment pattern data 30*a* of the N-th adjustment pattern is data representing the adjustment pattern that is to be printed N-th.

Then, the controller 20 extracts a part of the patterns represented by the acquired adjustment pattern data 30*a*. That is, the controller 20 extracts patterns associated with the amount of adjustment included within a predetermined range the center of which is the same as an (N−1) adjustment amount acquired in a step S120 (described later) that was executed for an (N−1)-th adjustment pattern, and sets the extracted patterns as the target of printing. If N=1, the controller 20 sets the whole of the patterns represented by the adjustment pattern data 30*a* as the target of printing.

Next, the controller 20 commands that the N-th adjustment pattern should be printed (step S110). Specifically, based on the adjustment pattern data 30*a* of the patterns set as the target of printing in the step S105, the controller 20 controls the carriage 40 and the transportation mechanism 60 to print the adjustment pattern.

Next, the controller 20 commands that the N-th adjustment pattern should be read (step S115). Specifically, the controller 20 controls the transportation mechanism 60, the carriage 40, and the sensor unit 42 to read the adjustment pattern printed in the step S110. Next, the controller 20 acquires an N-th adjustment amount (step S120). Specifically, the controller 20 chooses the pattern that has the highest lightness from among the patterns read in the step S115, and acquires the amount of adjustment associated with the chosen pattern as the N-th adjustment amount.

Next, the controller 20 sets an N-th parameter (step S125). Specifically, the controller 20 determines each parameter that needs to be set in each component of the printing apparatus 10 in order to perform printing with the N-th adjustment amount in the printing apparatus 10. Then, the controller 20 causes the nonvolatile memory 30 store the value as the parameter for an N-th mode (i.e., mode for performing printing with N-th print quality).

Next, the controller 20 determines whether the adjustment pattern printing has finished or not (step S130). Specifically, the controller 20 determines in the step S130 that the adjustment pattern printing has finished if the adjustment pattern having been printed last is the last one in the order of printing adjustment patterns. If so, the adjustment processing is ended.

If the adjustment pattern printing has not finished yet, the controller 20 increments the variable N (step S135) and repeats the processing in the step S105 and the subsequent steps. As a result of the above processing, an adjustment for the target of adjustment for each of different levels of print quality ends.

(4) Other Embodiments

The foregoing embodiment is just for giving an example. Various other embodiments can be adopted. For example, the printing apparatus 10 may be integrated into an apparatus that has a print function and other functions. The printing apparatus 10 may use other printing method instead of ink-jet printing, for example, electrophotographic printing. Moreover, the technique described in the foregoing embodiment for making the amount of printing the later adjustment pattern smaller based on the amount of adjustment acquired based on the earlier adjustment pattern, as compared with a case where the amount of adjustment is unknown, can be implemented as an invention of a printing apparatus, an invention of an adjustment pattern printing program that is to be executed by a computer, for example.

The functions recited in the appended claims may be implemented by hardware resources the functions of which are defined by hardware architecture itself, by hardware resources the functions of which are defined by a program, or by a combination of them. These functions of components do not necessarily have to be implemented by physically independent hardware resources. Moreover, since the foregoing embodiment is just for giving an example, partial omission of the disclosed configuration, addition of other configuration to the disclosed configuration, and/or replacement may be applied.

Figure 7:
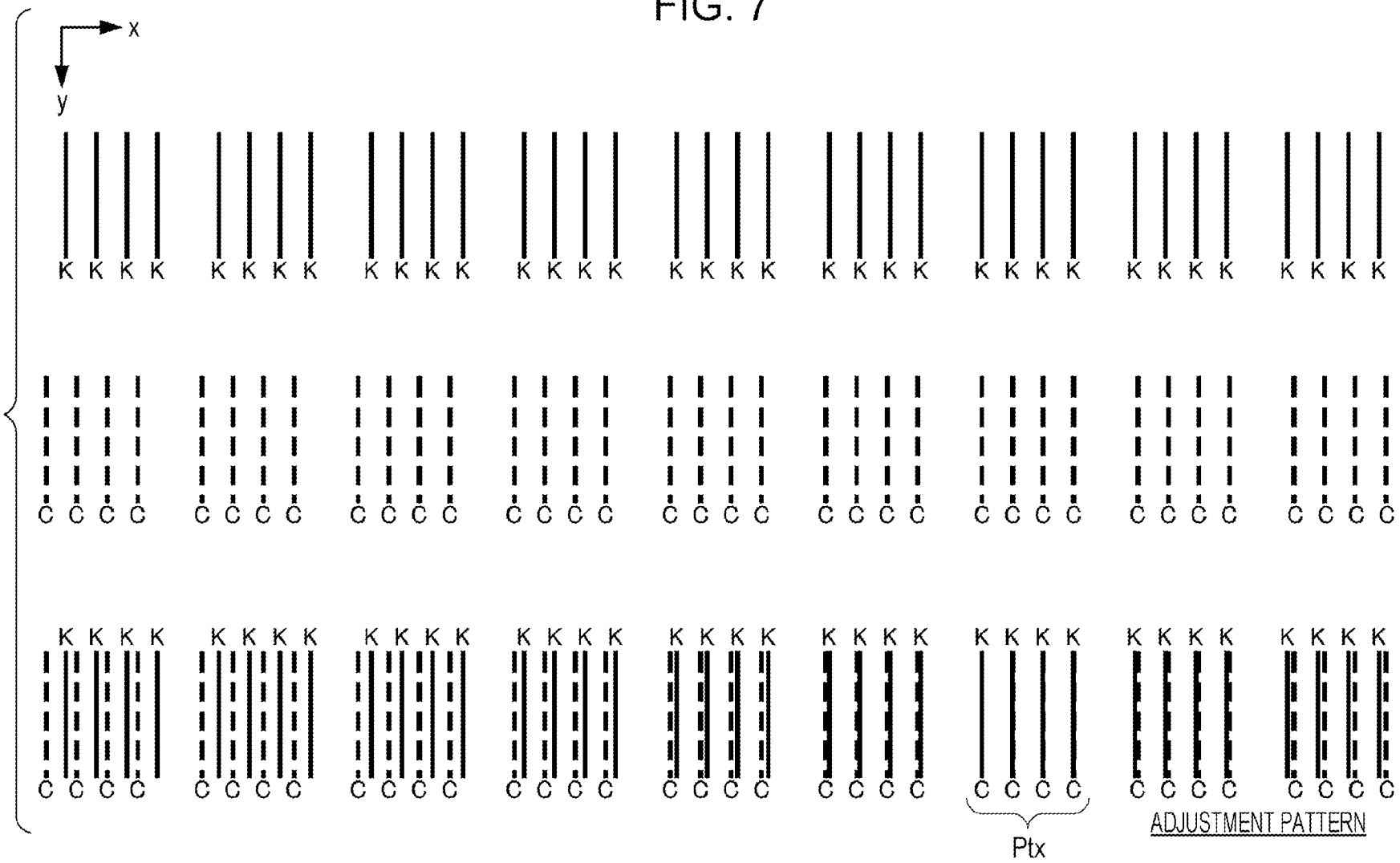
FIG. 7 is a diagram that illustrates an example of an adjustment pattern.

Furthermore, the target of adjustment is not limited to the timing of ejecting ink described in the foregoing embodiment. Nor is the adjustment pattern limited to the foregoing example. FIG. 7 is a diagram illustrating an adjustment pattern for making an adjustment so as to get rid of misalignment in print position between colors of ink. Specifically, on the carriage 40 of the printing apparatus 10, nozzles for ejecting ink of the same color are arranged in the sub-scan direction, and nozzles for ejecting ink of different colors are arranged in the main-scan direction. Therefore, if there is an error such as a deviation in nozzle position, misalignment in print position could occur even if ink of different colors is ejected at the designed timing.

In order to eliminate the misalignment, for example, the timing of ejecting ink of predetermined colors is adjusted. Specifically, the timing of ejecting ink of a particular color is set as designed, and the timing of ejecting ink of the rest of colors is adjusted. By this means, it is possible to eliminate the misalignment in print position between the colors. FIG. 7 illustrates an example of an adjustment pattern printed when the timing of ejecting K ink is set as designed and the timing of ejecting C ink is adjusted.

In FIG. 7, an adjustment pattern is schematically illustrated at the bottom row. The adjustment pattern is printed by forming a printed array of patterns in the main-scan direction, wherein each of the plurality of patterns is constituted of a plurality of line segments each extending in the sub-scan direction. Line segments printed using K ink only and line segments printed using C ink only are included in the respective patterns. In FIG. 7, the line segments printed using the K ink are schematically illustrated at the top row, and the line segments printed using the C ink are schematically illustrated at the middle row. In FIG. 7, the line segments printed using the C ink are indicated by broken lines. The character K, C annexed to each line segment indicates the color of ink and is not a part of the pattern. In this example, the direction of movement of the carriage 40 is not specifically limited. However, it will be advantageous if the carriage 40 moves in the same direction together with K, C ink cartridges so as to perform printing.

Also in the adjustment pattern illustrated in FIG. 7, each pattern array is constituted of nine patterns arranged in the main-scan direction. In the example illustrated in FIG. 7, each pattern is constituted of four line segments. In this example, the amount of adjustment when the K ink is used for printing is not varied from a predetermined adjustment amount. Therefore, as shown at the top row in FIG. 7, a line-to-line pitch in each pattern is constant, and there is a predetermined interval between adjacent patterns.

On the other hand, in the adjustment pattern illustrated in FIG. 7, the amount of adjustment when the C ink is used for printing varies from one to another of the nine patterns arranged in the main-scan direction such that the change in the amount of adjustment increases from one end to the other end in the main-scan direction. When the patterns are printed using the ink of these two colors, the adjustment pattern shown at the bottom row of FIG. 7 is formed. In the pattern example described here, similarly to the foregoing example, a line will be thin if the print position of the K ink and the print position of the C ink are in alignment with each other. A line will be thick if the two are not in alignment with each other. In the example illustrated in FIG. 7, the lightness of a pattern Ptx is highest. Therefore, in the pattern example illustrated in FIG. 7, the timing of ejecting ink for the pattern Ptx, which has the highest lightness among the individual patterns, can be said to be most ideal.

Therefore, by controlling the carriage 40, the transportation mechanism 60, and the sensor unit 42 by the controller 20 to read the adjustment pattern and find the pattern that has the highest lightness, it is possible to determine the amount of adjustment associated with the found pattern as an ideal adjustment amount. In the patterns illustrated in FIG. 7, the color will become more achromatic if the print position of the K ink and the print position of the C ink become closer to each other, relatively to a case where they are distant from each other. Therefore, an ideal adjustment amount may be determined based on the chroma of the patterns.

It is possible to reduce the amount of printing when another adjustment pattern is printed for the same target of adjustment after determining the amount of adjustment using the adjustment pattern described above. For example, suppose that the adjustment pattern illustrated in FIG. 7 has been printed as the first adjustment pattern and that the first adjustment amount for the first print quality has been acquired. Further suppose that the second adjustment pattern is printed next in order to adjust the print position of the K ink and the print position of the C ink for the second print quality different from the first print quality. In this instance, based on the first adjustment amount, it is possible to reduce the amount of printing the second adjustment pattern. That is, if the first adjustment amount is unknown, it is necessary to print the second adjustment pattern while varying the amount of adjustment throughout the entire variable range. However, if the first adjustment amount is known, it is possible to form the second adjustment pattern by printing only patterns that are to be printed with the amount of adjustment similar to the first adjustment amount, and to acquire the second adjustment amount.

Figure 8:
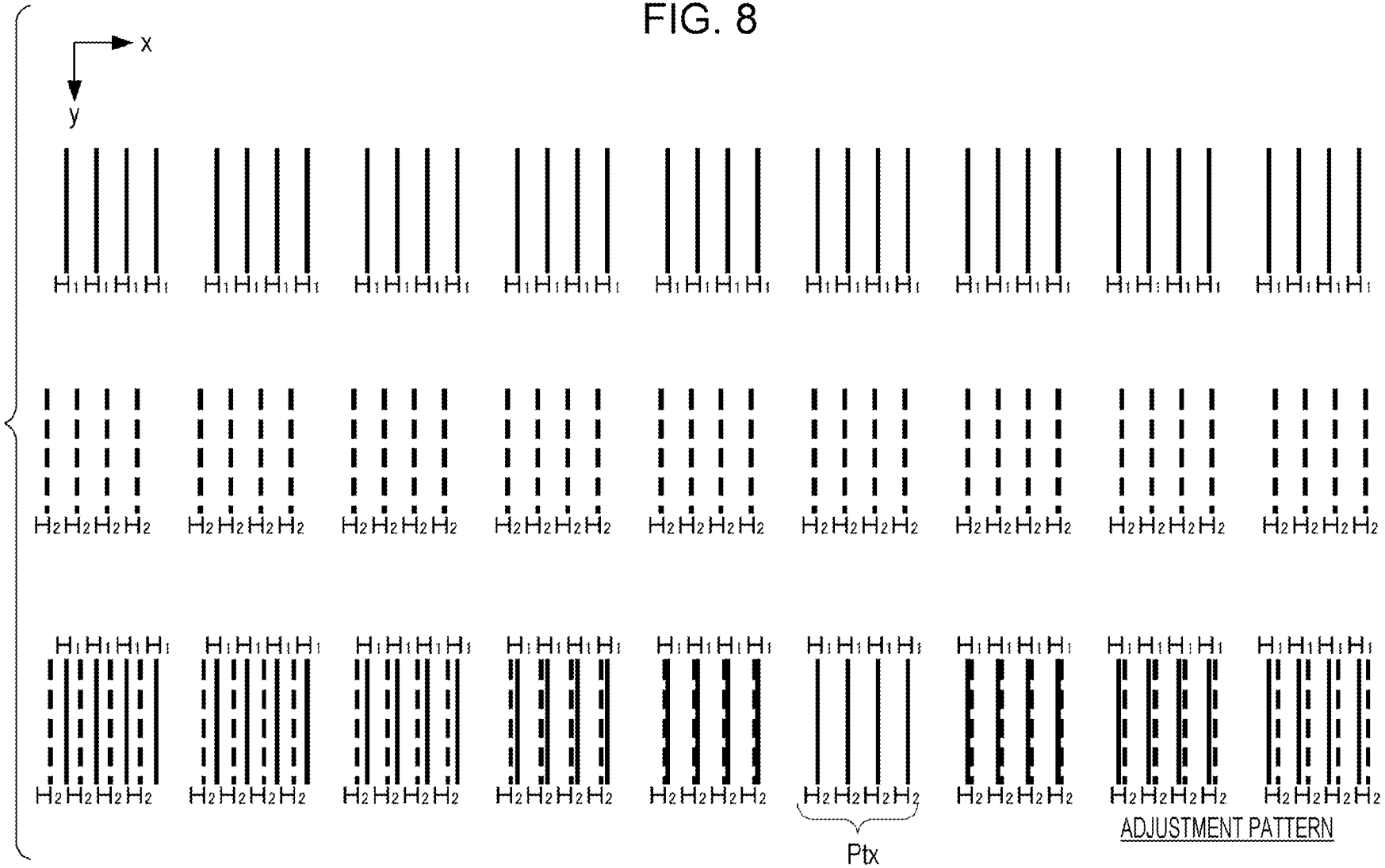
FIG. 8 is a diagram that illustrates an example of an adjustment pattern.

FIG. 8 is a diagram illustrating an adjustment pattern for making an adjustment so as to get rid of misalignment in print position between print heads. In some instances the printing apparatus 10 is equipped with a plurality of print heads. If there is an error in an inclination of a supporting unit configured to restrict a print head movement direction or an inclination of a print head, etc., misalignment in print position could occur between print heads even if ink is ejected at the designed timing.

In order to eliminate the misalignment, for example, the timing of ejecting ink from a certain print head is set as designed, and the timing of ejecting ink from another print head is adjusted. By this means, it is possible to eliminate the misalignment in print position between the print heads. FIG. 8 illustrates an example of an adjustment pattern printed when the timing of ejecting ink from a first print head $H_1$ is set as designed and the timing of ejecting ink from a second print head $H_2$ is adjusted.

In FIG. 8, an adjustment pattern is schematically illustrated at the bottom row. The adjustment pattern is printed by forming a printed array of patterns in the main-scan direction, wherein each of the plurality of patterns is constituted of a plurality of line segments each extending in the sub-scan direction. Line segments printed by the first print head $H_1$ only and line segments printed by the second print head $H_2$ only are included in the respective patterns. In FIG. 8, the line segments printed by the first print head $H_1$ are schematically illustrated at the top row, and the line segments printed by the second print head $H_2$ are schematically illustrated at the middle row. In FIG. 8, the line segments printed by the second print head $H_2$ are indicated by broken lines. The character $H_1$, $H_2$ annexed to each line segment indicates the result of printing by the first print head, the second print head, and is not a part of the pattern. In this example, the direction of movement of the carriage 40 is not specifically limited. However, it will be advantageous if the carriage 40 moves in the same direction together with the first print head $H_1$ and the second print head $H_2$ so as to perform printing. Moreover, although the color of the line segments is not specifically limited, it will be advantageous if printing is performed using a single color.

Also in the adjustment pattern illustrated in FIG. 8, each pattern array is constituted of nine patterns arranged in the main-scan direction. In the example illustrated in FIG. 8, each pattern is constituted of four line segments. In this example, the amount of adjustment when the first print head $H_1$ is used for printing is not varied from a predetermined adjustment amount. Therefore, as shown at the top row in FIG. 8, a line-to-line pitch in each pattern is constant, and there is a predetermined interval between adjacent patterns.

On the other hand, in the adjustment pattern illustrated in FIG. 8, the amount of adjustment when the second print head $H_2$ is used for printing varies from one to another of the nine patterns arranged in the main-scan direction such that the change in the amount of adjustment increases from one end to the other end in the main-scan direction. When the patterns are printed using these two print heads, the adjustment pattern shown at the bottom row of FIG. 8 is formed. In the pattern example described here, similarly to the foregoing example, a line will be thin if the print position of the first print head $H_1$ and the print position of the second print head $H_2$ are in alignment with each other. A line will be thick if the two are not in alignment with each other. In the example illustrated in FIG. 8, the lightness of a pattern Ptx is highest. Therefore, in the pattern example illustrated in FIG. 8, the timing of ejecting ink for the pattern Ptx, which has the highest lightness among the individual patterns, can be said to be most ideal.

Therefore, by controlling the carriage 40, the transportation mechanism 60, and the sensor unit 42 by the controller 20 to read the adjustment pattern and find the pattern that has the highest lightness, it is possible to determine the amount of adjustment associated with the found pattern as an ideal adjustment amount. It is possible to reduce the amount of printing when another adjustment pattern is printed for the same target of adjustment after determining the amount of adjustment using the adjustment pattern described above. For example, suppose that the adjustment pattern illustrated in FIG. 8 has been printed as the first adjustment pattern and that the first adjustment amount for the first print quality has been acquired. Further suppose that the second adjustment pattern is printed next in order to adjust the print position of the first print head $H_1$ and the print position of the second print head $H_2$ for the second print quality different from the first print quality. In this instance, based on the first adjustment amount, it is possible to reduce the amount of printing the second adjustment pattern. That is, if the first adjustment amount is unknown, it is necessary to print the second adjustment pattern while varying the amount of adjustment throughout the entire variable range. However, if the first adjustment amount is known, it is possible to form the second adjustment pattern by printing only patterns that are to be printed with the amount of adjustment similar to the first adjustment amount, and to acquire the second adjustment amount.

Figure 9:
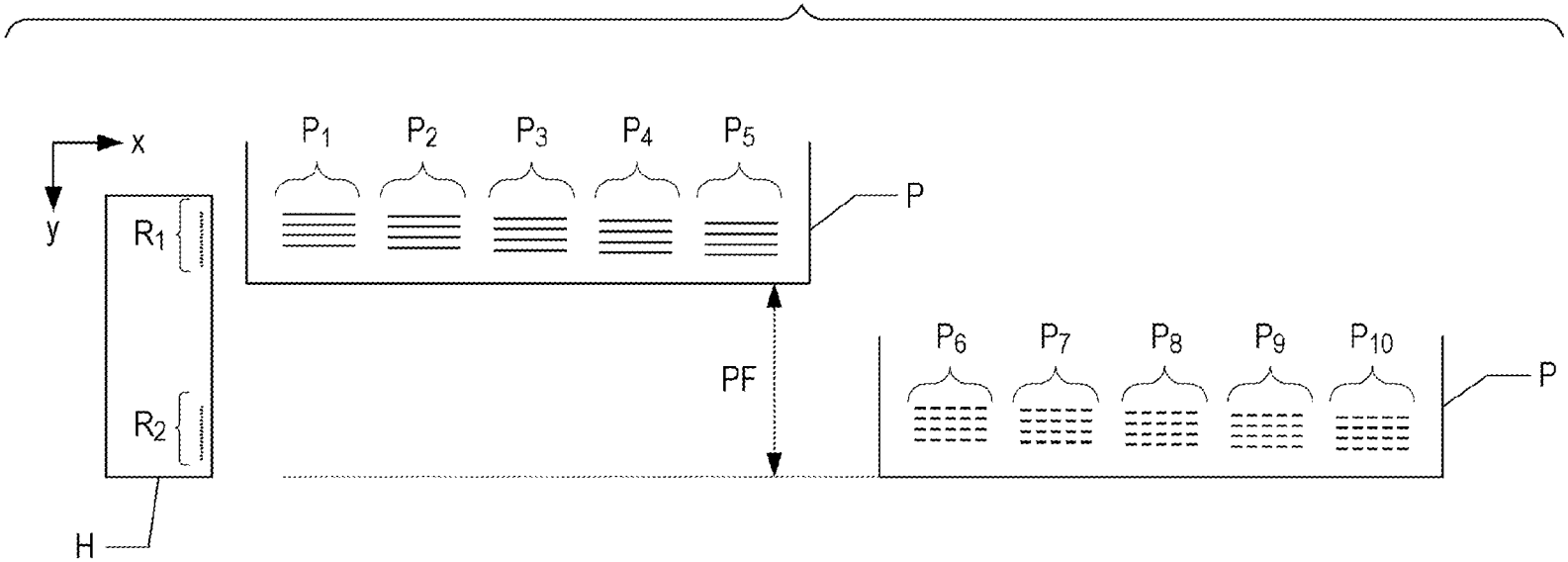
FIG. 9 is a diagram that illustrates an example of an adjustment pattern.

FIG. 9 is a diagram illustrating an adjustment pattern for making an adjustment so as to get rid of misalignment in print position caused due to an amount of feed by the transportation mechanism 60. The print head of the printing apparatus 10 has a plurality of nozzles arranged in the sub-scan direction. In order to perform printing at the same position of a printing medium by using different nozzles provided at different positions in the sub-scan direction, it is necessary to move the printing medium in the sub-scan direction by the transportation mechanism 60. If the amount of feed by the transportation mechanism 60 is deviated from the designed amount of feed, misalignment in print position could occur when, after printing is performed at a certain portion, the printing medium is sub-scanned by the transportation mechanism 60 and printing is performed at the same portion.

In order to eliminate the misalignment, for example, it is necessary to determine a parameter for operating the transportation mechanism 60 such that the deviation from the designed amount of feed will be eliminated. It is difficult to configure the transportation characteristics of the transportation mechanism 60 exactly as designed. However, once the characteristics of an amount of transportation for each amount of adjustment (transportation amount versus voltage) in a certain individual are known, it is possible to realize a transportation amount as designed. Therefore, if the transportation characteristics of the transportation mechanism 60 are determined by printing an adjustment pattern, it becomes possible to determine an ideal parameter.

FIG. 9 illustrates an adjustment pattern for determining the transportation characteristics of the transportation mechanism 60. In the example illustrated in FIG. 9, nozzles provided in an area $R_1$ of a print head H and nozzles provided in an area $R_2$ of the print head H are schematically shown. The adjustment pattern of this example is formed by, after performing printing, performing transportation by the transportation mechanism 60 and performing printing again. In FIG. 9, patterns printed earlier on a printing medium P are depicted as patterns $P_1$ to $P_5$ indicated by solid line segments, and patterns printed later on the printing medium P are depicted as patterns $P_6$ to $P_{10}$ indicated by broken line segments. Each of the patterns $P_1$ to $P_{10}$ illustrated in FIG. 9 is constituted of a plurality of line segments (four line segments in FIG. 9), wherein each of the plurality of line segments extends in the main-scan direction.

The patterns $P_1$ to $P_5$, which are printed earlier, are printed using nozzles selected from the area $R_1$ of a print head H. The patterns $P_6$ to $P_{10}$, which are printed later, are printed using nozzles selected from the area $R_2$ of the print head H. Among the patterns $P_1$ to $P_{10}$, the same pattern is printed using particular nozzles determined in advance, and different patterns are printed using different nozzles.

The patterns $P_6$ to $P_{10}$, which are printed later, are printed at an area overlapping with the patterns $P_1$ to $P_5$, which are printed earlier. For example, the pattern $P_6$ is printed at an area overlapping with the pattern $P_1$. Therefore, if there is a complete pattern overlap after printing the later pattern (the highest lightness), it tells that the distance of transportation by the transportation mechanism 60 is the same as the distance between the nozzles used for the pattern printed earlier and the pattern printed later. By predetermining nozzles that are to be used for printing the patterns $P_1$ to $P_{10}$, therefore, it is possible to know the amount of transportation by the transportation mechanism 60, based on the pitch between the nozzles that were used for printing the patterns that overlap best.

In a configuration of transporting a printing medium by the transportation mechanism 60 as described above wherein the amount of feed is defined as a transportation amount PF, in the present embodiment, printing with different values of the transportation amount PF is performed more than once. Specifically, the controller 20 repeats processing of printing the earlier pattern and the later pattern more than once, with the amount of adjustment for varying the transportation amount PF predetermined, and with the nozzles to be used predetermined, thereby printing an adjustment pattern.

Next, the controller 20 controls the sensor unit 42 to read each of the patterns that constitute the adjustment pattern. Then, the controller 20 deems the nozzle pitch associated with the pattern whose lightness is equal to or greater than a predetermined value as the amount of transportation by the transportation mechanism 60. Then, based on the deemed amount of transportation and the amount of adjustment (voltage) at the transportation mechanism 60, the controller 20 finds a relation between arbitrary amount of adjustment and amount of transportation (characteristics of the transportation mechanism 60). The controller 20 deems, as the first adjustment amount, the amount of adjustment (voltage) that is necessary for obtaining the amount of transportation as designed.

It is possible to reduce the amount of printing when another adjustment pattern is printed for the same target of adjustment after determining the amount of adjustment using the adjustment pattern described above. For example, suppose that the adjustment pattern illustrated in FIG. 9 has been printed as the first adjustment pattern and that the first adjustment amount for the first print quality has been acquired. Further suppose that the second adjustment pattern is printed next in order to find a relation between the amount of adjustment at the transportation mechanism 60 and the amount of transportation, for the second print quality different from the first print quality. In this instance, based on the first adjustment amount, it is possible to reduce the amount of printing the second adjustment pattern. That is, if the first adjustment amount is unknown, it is necessary to print the second adjustment pattern while varying the amount of adjustment throughout the entire variable range. However, if the first adjustment amount is known, it is possible to form the second adjustment pattern by printing only patterns that are to be printed with the amount of adjustment similar to the first adjustment amount, and to acquire the second adjustment amount.

It suffices that the printing apparatus is able to perform printing while varying the amount of adjustment of the target of adjustment. The target of adjustment may be any factor among variable factors of the printing apparatus as long as it could change the result of printing. For example, if it is possible to adjust the amount of an error that could occur by adjusting a variable amount in the printing apparatus, this adjustable amount can be taken as the amount of adjustment of the target of adjustment. Examples of the error are: an error in the amount of movement and/or the direction of movement when a print head reciprocates, a print head level error, a platen gap error, a carriage speed error, an error between a plurality of print heads of a multi-head printing apparatus, an error in the amount of paper feed, and a nozzle pitch error.

The target of adjustment for which the amount of such an error is adjusted could be a plurality of targets of adjustment. Examples of the target of adjustment are: the timing of ejecting ink, the speed of moving the print head, the amount of ink ejected, the waveform and magnitude of a voltage for ejecting ink, the amount of feeding a sheet, as described earlier. Needless to mention, examples are not limited to those enumerated here, and an adjustment with the amount of adjustment may be made for any other kind of target of adjustment. The printing apparatus for which an adjustment is made is not limited to an ink-jet printer. Needless to mention, the target of adjustment may contain a plurality of items. The amount of adjustment may be a variable amount for each target of adjustment. When an adjustment pattern is printed, a plurality of adjustment amounts covering the entirety of an adjustable range may be selected, or a plurality of adjustment amounts covering a part of an adjustable range may be selected.

The first adjustment pattern may be any predetermined patterned arrangement as long as it is printed using different values of the amount of adjustment. That is, the first adjustment pattern is patterned arrangement for knowing the differences in print quality (the degree of an error), differing from amount to amount of adjustment. Therefore, it will be advantageous if the first adjustment pattern is patterned arrangement of the same print contents printed repeatedly with differences in the amount of adjustment. Such patterned arrangement makes it possible to know which one of different values of the amount of adjustment is suited for being taken as the first adjustment amount based on the print result of the first adjustment pattern.

Regarding the first adjustment amount, as long as the first adjustment amount is acquired by reading the printed first adjustment pattern, it suffices. Since the first adjustment pattern is patterned arrangement producing the differences in print quality, differing from amount to amount of adjustment, a configuration of a plurality of patterned elements that vary in item for evaluating print quality, for example, lightness, line misalignment, chroma, etc. can be adopted. It suffices to take, as the first adjustment amount, the amount of adjustment that was set when printing the one offering the best print quality (minimizing the error) as the result of reading them. Although the first adjustment pattern is read by a sensor in the foregoing embodiment, the one offering the best print quality among those in the patterned arrangement may be found by a human, and the first adjustment amount may be determined based on an input by the human via a non-illustrated user interface specifying the one offering the best print quality.

Similarly to the first adjustment pattern, the second adjustment pattern may be any patterned arrangement as long as it is obtained by printing a predetermined image using different values of the amount of adjustment. However, when the second adjustment pattern is printed, the amount of adjustment is not varied throughout the entire variable range of the amount of adjustment supposed as the second adjustment pattern. That is, the second adjustment pattern is printed while omitting a part of the variable range and varying the amount of adjustment for the rest only.

The amount of adjustment varied when the first adjustment pattern is printed and the amount of adjustment varied when the second adjustment pattern is printed may be for adjustment for the same cause of an error or may be for different causes. Anyway, it is sufficient as long as the determination of the first adjustment amount makes it possible to narrow down the range of the amount of adjustment varied when the second adjustment pattern is printed. The print position of the second adjustment pattern may be any position. For example, if partial printing is performed in a case where patterns would exist throughout the entire area in the main-scan direction if the entirety of the second adjustment pattern were printed, the patterns will not be distributed throughout the entire area in the main-scan direction. In such a case, the second adjustment pattern may be printed at and near the center in the main-scan direction. If patterns that are to be printed exist at a non-center position in an unbalanced manner due to omission of a part of the second adjustment pattern, the second adjustment pattern may be printed without correcting the unbalance.

Similarly to the acquisition of the first adjustment amount, it suffices that the second adjustment amount is acquired by reading the second adjustment pattern. Since the second adjustment pattern is patterned arrangement producing the differences in print quality, differing from amount to amount of adjustment, a configuration of a plurality of patterned elements that vary in item for evaluating print quality, for example, lightness, line misalignment, chroma, etc. can be adopted. It suffices to take, as the second adjustment amount, the amount of adjustment that was set when printing the one offering the best print quality (minimizing the error) as the result of reading them. Although the second adjustment pattern is read by a sensor in the foregoing embodiment, the one offering the best print quality among those in the patterned arrangement may be found by a human, and the second adjustment amount may be determined based on an input by the human via a non-illustrated user interface specifying the one offering the best print quality.

The first parameter indicates the amount of adjustment as the result of adjustment determined based on the first adjustment amount. Therefore, the first parameter may be equal to the first adjustment amount or may be an adjustment amount determined from the first adjustment amount. One of examples of the latter is: if an adjustment amount A and an adjustment amount B are determined to offer equal highest print quality based on the first adjustment pattern, an adjustment amount between the adjustment amount A and the adjustment amount B (e.g., the average) is taken as the first parameter. Another example is to take an adjustment amount determined based on the first adjustment amount and another adjustment amount (e.g., the average, the value before the adjustment) as the first parameter. The second parameter is similar to the first parameter in that the second parameter indicates the amount of adjustment as the result of adjustment determined based on the second adjustment amount. Therefore, similarly to the first parameter, various kinds of configuration are adoptable for the second parameter.

In the foregoing embodiment, in order to set parameters to be used for different levels of print quality for the same target of adjustment, adjustment patterns are printed with the respective levels of print quality. However, this printing may be performed for the same/similar kind of target of adjustment. The "same/similar kind of target of adjustment" means the target of adjustment for which the print result that changes due to the change in the amount of adjustment is the same or similar. For example, if the timing of ejecting ink is adjusted for each of different levels of print quality, the target of adjustment in each level of print quality is the timing of ejecting ink, meaning the same target of adjustment. On the other hand, adjusting the timing of ejecting ink makes it possible to change an ink recording position in the main-scan direction, and adjusting the speed of moving the carriage 40 also makes it possible to change an ink recording position in the main-scan direction. Therefore, the timing of ejecting ink and the speed of moving the carriage 40 can be said as similar kind of target of adjustment in relation to each other.

When the second adjustment pattern is printed, it suffices to select a partial range of the amount of adjustment determined according to the first adjustment amount from the entire range of the amount of adjustment used for printing the second adjustment pattern, wherein this range may be variable. For example, the partial range may be made relatively narrow if the minimum value of the misalignment that has occurred in the first adjustment pattern is relatively small, as compared with a case where it is relatively large. More specifically, suppose two cases: one where the minimum value of the misalignment that has occurred in the first adjustment pattern is zero and the other where the minimum value of the misalignment that has occurred in the first adjustment pattern is greater than zero. In this example, the reliability of the first adjustment amount of the former is higher. Therefore, the probability is high that the change width of the amount of adjustment required for making an adjustment will be narrower for the former when the amount of adjustment is varied based on the first adjustment amount, for example, with the first adjustment amount taken as the center.

Therefore, it is possible to reduce the amount of printing the second adjustment pattern if the minimum value of the misalignment that has occurred in the first adjustment pattern is relatively smaller, as compared with a case where it is relatively large. For example, the following configuration may be adopted. In the example illustrated in FIG. 3, if the lightness of the pattern Ptx, which is highest, is not greater than a threshold, the patterns $Pt_2$ illustrated in FIG. 5 are printed as the second adjustment pattern. If the lightness of the pattern Ptx is greater than the threshold, the patterns $Pt_{21}$ illustrated in FIG. 5 are printed as the second adjustment pattern.

The target of adjustment may be selectable by a user. In such a user-selectable configuration, an adjustment pattern printed for making an adjustment for a case where a certain target of adjustment is selected first time may be different from an adjustment pattern printed for making an adjustment for a case where, before the certain target of adjustment, other target of adjustment relevant thereto was selected to make an adjustment. That is, the entirety of the first adjustment pattern is printed for making an adjustment if a certain target of adjustment is selected first time. If a selection and an adjustment are made after selecting other target of adjustment relevant thereto and making an adjustment, only a part of the first adjustment pattern is printed. This part may be determined according to the result of adjusting the other target of adjustment relevant thereto.

What is claimed is:

1. A method for manufacturing a printing apparatus configured to perform printing while varying an amount of adjustment of a target of adjustment, comprising:

printing a first adjustment pattern on a printing medium;

reading the printed first adjustment pattern to acquire a first adjustment amount;

printing a part of a second adjustment pattern on the printing medium, the printed part of the second adjustment pattern corresponding to only a part of the amount of adjustment according to the first adjustment pattern;

reading the printed part of the second adjustment pattern to acquire a second adjustment amount;

setting a first parameter that is a result of adjusting the target of adjustment by using the first adjustment amount; and setting a second parameter that is a result of adjusting the target of adjustment by using the second adjustment amount.

2. The method for manufacturing the printing apparatus according to claim 1, wherein in setting the first parameter, the first parameter is stored in a first area of a nonvolatile memory, and in setting the second parameter, the second parameter is stored in a second area different from the first area of the nonvolatile memory.

3. The method for manufacturing the printing apparatus according to claim 1, wherein the first parameter is a parameter that is used when printing with first print quality is performed and is not used when printing with second print quality is performed, and the second parameter is a parameter that is used when printing with the second print quality is performed and is not used when printing with the first print quality is performed.

4. The method for manufacturing the printing apparatus according to claim 1, wherein a range of the part of the amount of adjustment according to the first adjustment pattern is relatively narrow when a minimum value of misalignment occurring in the first adjustment pattern is relatively small, as compared with when the minimum value is relatively large.

5. A printing apparatus configured to perform printing while varying an amount of adjustment of a target of adjustment, executing:

printing a first adjustment pattern on a printing medium;

reading the printed first adjustment pattern to acquire a first adjustment amount;

printing a part of a second adjustment pattern on the printing medium, the printed part of the second adjustment pattern corresponding to only a part of the amount of adjustment according to the first adjustment pattern;

reading the printed part of the second adjustment pattern to acquire a second adjustment amount;

setting a first parameter that is a result of adjusting the target of adjustment by using the first adjustment amount;

setting a second parameter that is a result of adjusting the target of adjustment by using the second adjustment amount; and performing printing using the set parameters.

* * * * *